United States Patent [19]

Lothamer

[11] Patent Number: 4,725,010

[45] Date of Patent: Feb. 16, 1988

[54] CONTROL APPARATUS AND METHOD

[75] Inventor: David J. Lothamer, Fort Wayne, Ind.

[73] Assignee: Essex Group, Inc., Fort Wayne, Ind.

[21] Appl. No.: 11,945

[22] Filed: Feb. 4, 1987

Related U.S. Application Data

[63] Continuation-in-part of Ser. No. 886,702, Jul. 18, 1986.

[51] Int. Cl.[4] ..... B65H 54/12; B65H 54/32

[52] U.S. Cl. ..... 242/16; 242/25 R; 242/158 R; 242/158.2; 242/158.4 R

[58] Field of Search ..... 242/25 R, 16, 17, 158 R, 242/158 B, 158 F, 158.2, 158.4 R, 158.4 A

[56] References Cited

U.S. PATENT DOCUMENTS

| | | | |
|---|---|---|---|
| 3,413,834 | 12/1968 | Kovaleski | 242/25 R X |
| 3,433,434 | 3/1969 | Latter | 242/158 R |
| 3,876,167 | 4/1975 | Nittschalk et al. | 242/25 R X |
| 4,004,744 | 1/1977 | Hoorelbeke | 242/25 R |
| 4,022,391 | 5/1977 | Stein et al. | 242/25 R |
| 4,083,506 | 4/1978 | Mander et al. | 242/25 R |
| 4,244,539 | 1/1981 | Taneda et al. | 242/158 R |
| 4,283,020 | 8/1981 | Bauer et al. | 242/25 R |
| 4,485,978 | 12/1984 | O'Connor | 242/25 R |
| 4,623,100 | 11/1986 | Tremblay | 242/25 R |
| 4,629,145 | 12/1986 | Graham | 242/25 R X |

*Primary Examiner*—Stanley N. Gilreath

*Attorney, Agent, or Firm*—Francis J. Maguire, Jr.

[57] ABSTRACT

Method and apparatus for correcting reversal points for a traverse for guiding a strand from a reference wheel onto a spool utilize signals indicative of the angular velocity of both a reference wheel and the spool to determine first the actual spool radius at a reference point away from the spool's flanges, then determining the proper spool radius at each reversal point and then determining the actual spool radius at each reversal point. The actual spool radius and the proper spool radius at each reversal point are compared and if a difference greater than a predetermined amount is present, the reversal point is altered by a selected incremental amount.

2 Claims, 6 Drawing Figures

CONTROL APPARATUS AND METHOD

CROSS REFERENCE TO RELATED APPLICATION

This application is a continuation-in-part of U.S. Ser. No. 886,702, filed on July 18, 1986.

TECHNICAL FIELD

This invention relates to a method and apparatus for controlling the winding of wire or any other strand-like or filamentary material onto spools having a wide variety of shapes and more particularly relates to a method and apparatus for winding an advancing strand onto a spool having end flanges of any shape including tapered, and a cylindrical or tapered barrel.

BACKGROUND ART

In the winding of wire or any other strand-like or filamentary material onto a rotating spool it is well known to guide the strand onto the spool with a reciprocating wire traverse guide which moves with strokes of increasing length as wire builds up on the spool. It is also known to wind strand onto a spool using an apparatus which empolys a strand guide flyer mounted for rotary movement around a spool.

Each of these types of machines have been designed fo winding wire onto spools which tapered flanges. Thus, they must include means for increasingly widening the limits of traversing movements, in response to build-up of wire on the spools, since successive layers become wider with such tapered flanges.

In the apparatus of U.S. Pat. No. 2,254,221, the distance of traverse movement is controlled with a switch actuatig lever which, upon physical engagement with the spool end flanges, effects a reversal of the traverse device.

The traverse reversing mechanism of U.S. Pat. No. 3,170,650 is controlled by a follower roller arranged to engage wire wound on the spool to effect an increase in the distance of traverse movement in response to build-up of wire on the spool.

In the apparatus of U.S. Pat. No. 3,413,834, the reversal points of the traverse guide are controlled by a timer which is effective to incrementally increase the movement limits of the traverse guide after a fixed period of time corresponding to a select number of traverse movements.

A counter is employed in the apparatus of U.S. Pat. No. 4,130,249 for counting the revolutions of the spool and for reversing the direction of movement of the wire traverse guide when the count reaches a predetermined number which is incrementally increased a given amount each time the movement of the traverse guide undergoes a given number of reversals.

Prior art wire winding machines of the type described above are generally of a highly complex nature, requireing substantial set-up times for adjusting and changing stops, limit switches, pinions, or the like for each different size of wire or for winding the same size wire on different sized of spool. Although the apparatus of U.S. Pat. No. 4,130,249 is of less complexity, it suffers from the disadvantage that it does not automatically compensate for variations in the size of the wire or other parameters affecting fill of the wire on the spool, such as wire tension, turns per inch, or different wire lubricities, all of which can affect the apparent density of the wire on a spool.

In the apparatus of U.S. Pat. No. 4,485,978, the motion of the strand guide is reversed when the number of tunes counted, from the flange apex of an out-turned conical flange (frustrum), reaches a value substantially equal to the quotient of a sensed length value divided by a predetermined reference value, which represents the length of a single turn of strand wound on the bare spool barrel. This apparatus suffers from the disadvantage that it is limited to spools having cylindrical barrels. In the manufacture of wire and other strand products, however, it is often advantageous to wind wire and the like onto spols having tapered barrels so that slackened wire does not fall and become entangled.

A need exists for a winding machine which winds wire or other filamentary or strand-like material onto a spool having a tapered barrel with flanges of any type including flat or tapered. This winding machine should not be of a complex nature requiring substantial set-up times for adjusting and changing stops, limit switches, pinions or the like for each different size of strand-like material or wire or for winding such material on different sizes of spools. It must automatically compensate for variations in the size of the strand or other parameters affecting fill of the strand on the spool such as strand tenseion, turns per inch, or different strand lubricities.

The winding machine should be capable of taking into account minor differences between spools of the same type due to manufacturing tolerances and other discrepancies which might tend to cause improper fill of the spool near the end flanges. This problem has been recognized in prior art winding machines and addressed, for example, in U.S. Pat. Nos. 3,038,674; 3,677,483; 3,876,167; 3,967,787; and 4,004,744.

DISCLOSURE OF THE INVENTION

An object of the present invention is to provide a method and apparatus for controlling the winding of a strand onto a spool having a cylindrical or tapered barrel by providing reversal signals for a traverse mechanism which guides wire in layers onto the barrel.

Another object of the present invention is to provide a method and apparatus for correcting the controlled winding of a strand onto such a spool in order to take into account and correct improper fill of a given spool.

In accordance with the present invention, an advancing strand of wire or filamentary material is monitored and an advance signal indicative of the advance in time of the strand is provided along with a spool signal indicative of the present rotation rate of a spool having the advancing strand helically wound in successive layers thereon; the advance signal and spool signal are provided to a signal processor which compares the magnitudes thereof and determines, from a relationship which may be solved according to the result of the comparison, the present points of intersection with the spool's ends of a line parallel to the surface of the spool's barrel and indicative of the present position or depth of the topmost layer of the strand on the spool's barrel. The points of intersection correspond to reversal points for a mechanism for guiding the strand repeatedly back and forth from end-to-end of the spool to form successive helical layers on the spool's barrel. The signal processor provides forward and reverse switching signals to the mechanism corresponding to the present points of intersection.

In further accord with the present invention, the spool may have one tapered end flange and the layers are therefore, in such a case, successively wider. Of course, the spool may have two tapered ends. Or, the spool may have one or more flat end pieces.

In still further accord with the present invention, the barrel of the spool may be tapered.

In still further accord with the present invention, the reversal points are referenced to a single reference point.

In still further accord with the present invention, the slope of the lime is taken with respect to a Cartesian coordinate system having its y-axis coincident with the axis of rotation of the spool. The slope is predetermined according to the geometry of the barrel of the particular type of spool being wound. The position of the line, as expressed by the known slope and the present value of its y-intercept, is determined by comparing the magnitude of a spool signal indicative of the period of revolution of the spool to the magnitude of an advance signal indicative of the period of revolution of a wheel or capstan in contact with the strand.

In still further accord with the present invention, the proper fill (not near the end flanges) is determined, the actual fill is measured at the reversal points and the difference between the proper fill and the actual fill is used to adjust the traverse reversal points to incrementally correct for the difference.

Each of the end flanges can be described by the equation of a line along the surface of the flange, intersecting the y-axis and in the same plane defined by theline parallel to the barrel and the y-axis. Each of the equations defining the surface of an end flange may be solved simultaneously with the equation of the line parallel to the barrel so as to obtain the point of intersection of the line with the flange.

The present apparatus and method is used for determining the reversal points for a strand traverse guide relative to a spool having end flanges at the end of a cylindrical or tapered shaped barrel at a speed proportional to the relative rotational velocity of the spool. The particular method and apparatus disclosed herein utilizes a strand guide mechanism which guides strands relative to the rotational speed of the spool rather than to the speed of the strand in order not to cause a change in the strand surface slope as the spool fills.

Thus, the present invention satisfies the need for a winding machine which winds wire or other filamentary or strand-like material onto a spool having either a cylindrical or tapered barre with flanges of any type including flat or tapered. The apparatus and method is very simple, requiring no substantial set-up times fosting and changing stops, limit switches, pinions or the like for each different size of strand-like material or wire or for winding such material on different sizes of spools. It automatically compensates for variations in the size of the strand or other parameters affecting fill of the strand on the spool, such as strand tension, turns per inch, or different strand lubricities.

In addition, the present invention has the capability of correcting the traverse reversal points to correct for a difference between proper fill and actual fill. Such differences can arise as a result of manufacturing tolerances and differences between individual spools within a given type of spool.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
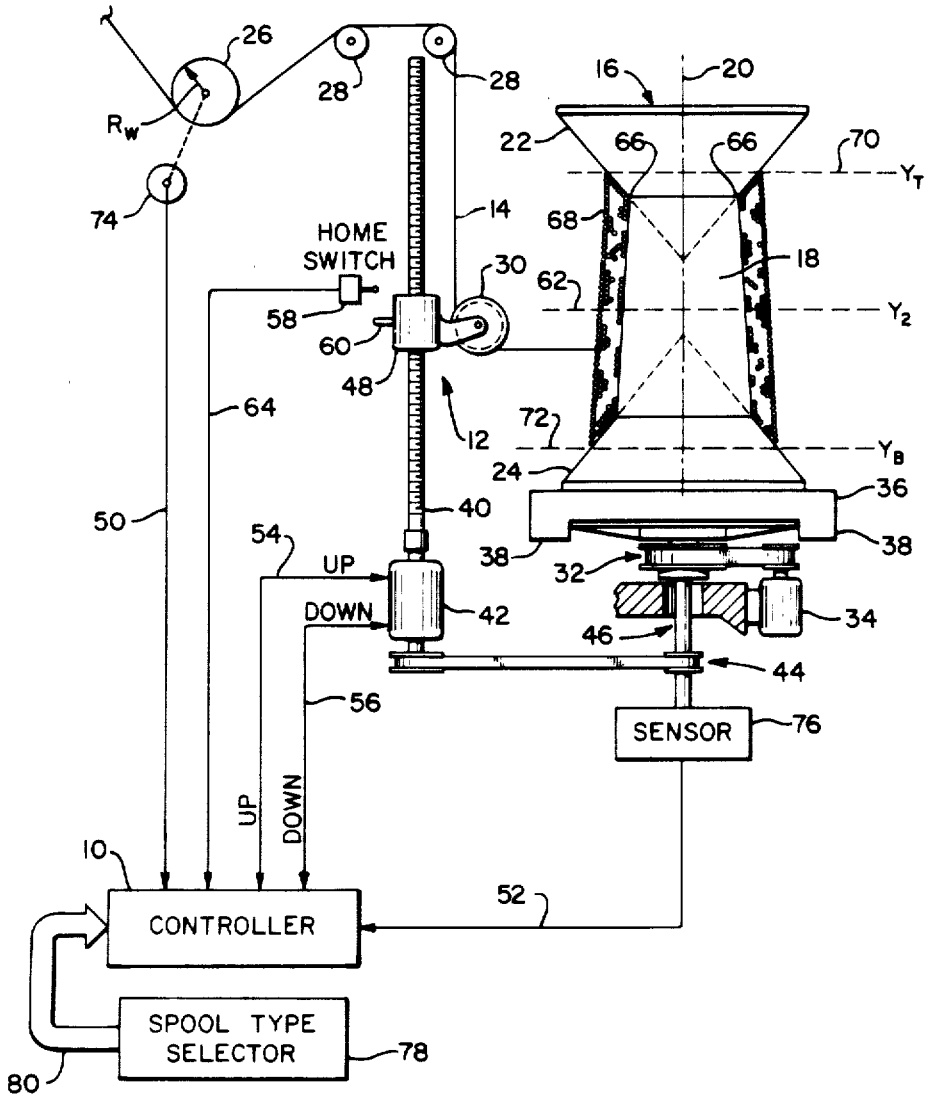
FIG. 1 is an illustration of a controller 10 and associated sensors 74, 76, according to the present invention, for use with a wire spooling apparatus.

FIG. 1 is an illustration of a controller 10, according to the present invention, for controlling the reversal points of a traverse mechanism 12 as it guides a strand 14 of wire or other filamentary material onto a take-up spool 16. The strand is guided onto the barrel 18 of the spool in successive layers. The spool may have straight end flanges (having faces perpendicular to a rotation axis 20) or may have out-turned conic section end flanges in the form of frusta 22, 24. The barrel 18 may be cylindrical or tapered as shown in FIG. 1.

If the end flanges have a straight horizontal shape the determination of the reversal points is a fairly simple matter since they will be the same every time. With an end flange having a frustum shape, as shown in FIG. 1, there is an additional complexity added since each successive layer is wider than the preceding layer and the reversal points become further apart as the depth of the layers on the barrel becomes greater. This particular problem was solved by the invention described in U.S. Pat No. 4,485,978. However, that particular solution did not address the added complexity of having, instead of a right circular cylinder for a barrel, a tapered barrel, such as is shown in FIG. 1. This adds an additional complexity which the present invention solves for barrels and end flanges of any type. In addition to solving that particular approach, the present invention is general and covers all cases.

As in the disclosure of U.S. Pat. No. 4,485,978, which is hereby expressly incorporated by reference, the strang 10, such as an insulated copper wire withdrawn from wire processing equipment or a supply real (not shown) is advaned into engagement with a wire feed capstan 26 of radius $R_p$ which either may be driven to advance the strand 14 at a given linear speed or may be rotated by the advancing strand at a speed proportional to a given linear speed of advancement thereof. The strand passes around one or more guide rollers 28 to a wire guide sheave 30 of the traverse mechanism 12. The sheave 30 distributes turns of the strand on the take-up spool 16 which is rotated about its central longitudinal axis 20 by means of a pulley and belt transmission 32 to an electric motor 34 or other suitable motive means.

In one form of the invention wherein the capstan 26 is rotated by the advancing strand 14 at a speed proportional to the speed of strand advancement, the motor 34 may be a conventional adjustable-speed motor which runs at a selected uniform speed to rotate the spool 16 with a substantially constant rotational velocity. In another form of the invention wherein the strand 14 is advanced by the capstan 26 at a generally uniform linear speed, the motor 34 is preferably of the constant-torque type. As is well known, a motor 34 of the latter type rotates the spool 16 with a controlled torque effective to maintain a substantially constant tension in the strand 14 being supplied to the spool 16. Because the strand is being supplied at a controlled rate, the speed of the motor and the rotational velocity of the spool are reduced as build-up of the strand on the spool increases the winding diameter thereof. Although the invention is more particularly described hereinafter in connection with the form employing a strand advancing capstan 26 and a spool rotating motor 34 of the constant-torque type, it will become evident that the invention is equally applicable to the alternate form employing a capstan 26 rotated by the advancing strand 14 and a spool rotating motor 34 of the adjustable speed type.

The spool 16, which may have a cylindrical barrel or a tapered barrel and which may have flat end pieces or tapered end pieces of any selected angularity such as shown in FIG. 1, may include an integral platform 36 with supporting legs 38 to permit transport of the spool with a forklift truck. However, tapered flange spools of other constructions such as those disclosed in U.S. Pat. Nos. 4,140,289 and 4,269,371 may be utilized in connection with the present invention.

The traverse mechanism 12 includes a screw shaft 40 journaled inspaced relation with the spool 16 and driven by the motor 34 at a rotational speed directly related to the rotational speed of the spool 16. The screw shaft 40 is connected to a reversing mechanism 42 which, in turn, is connected by a non-slip belt and pulley arrangement 44 to the main drive shaft 46. Depending on whether it is supplied with a forward (UP) or a reverse (DOWN) electrical signal from the controller 10, the reversing mechanism 42 causes the screw shaft 40 to rotate in either a clockwise or a counterclockwise direction. A carriage 48 which rotatability supports the sheave 30 carries a ball nut threadably engaging the screw shaft 40 for effecting reciprocation of the sheave 30 back and forth lengthwise of the spool 16 to distribute turns of strand 14 along the length of the spool.

In operation of the spooling apparatus shown in FIG. 1, an empty spool 16 is set in place for rotation by the motr 34. With the strand guide sheave 30 in the position at the bottom of the tapered shaft in FIG. 1, the strand 14 to be wound on the spool 16 is passed over the rollers 28 and around the sheave 30. The leading end of the strand is secured to the spool by tying it to a knob (not shown) on the platform or to the spool. Upon actuation of the capstan 26 to advance the strand toward te spool 16, the motor 34 is started and begins rotating the spool and the screw shaft 40. Turns of strand are helically wound upon the barrel 18 as the sheave 30 is advanced upwardly by the rotating screw shaft 40. A first layer of uniformly distributed helical turns of strand will thus be wound upon the spool barrel 18. Upon reaching end flange 22, the reversing mechanism 42 receives a DOWN signal and subsequently causes rotation of the screw shaft 40 in an opposite direction and the sheave 30 is advanced downwardly to wind a second layer of strand over the first layer. Further upward and downward traverses of the sheave 30 results in the build-up of strand 14 on the spool with the formation of superimposed layers of turns.

In accordance with the present invention, if the end flanges are straight horizontal end pieces, the reversal points are the same each time.

On the other hand, in order to distribute the strand 14 in successively wider layers for tapered end flanges, such as is shown in FIG. 1, the limits of reciprocation of the sheave 30 are controlled in accordance with the present invention to automatically increase the extent of movement of the sheave 30 during the wire build-up on the spool. To accomplish this control, means are provided to: (1) provide an advance signal 50 indicative of the advance in time of the advancing strand 14; (2) provide a spool signal 52 indicative of the present rotation rate of the spool 16 having the advancing strand helically wound in successive layers thereon; (3) comparing the magnitudes of the advance signal and the spool signal and determinging therefrom the present poits of intersection of the spool's end flanges with a line parallel to the surface of the spool's barrel and indicative of the present position of the topmost layer of the strand on the barrel such that the points of intersection correspond to reversal points for the traverse mechanism 12 for guiding the strand repeatedly back and forth from end-to-end of the spool to form the successive helical layers on the barrel; and, (4) providing forward and reverse switching signals to the traverse mechanism 12 corresponding to the present points of intersection with the end flanges.

One means for establishing and determining a reference position is to provide a home switch 58 which may be actuated by an actuator 60 mounted on the carrieage 48 and positioned to actuate the home switch as the strand 14 passes through a reference position 62 on the barrel 18 as the carriage moves upwardly. The home switch then provides a reference signal on a line 64 to the controller 10.

Assuming that the sheave 30 is laying down the first layer of strand on the barrel 18, in an upward direction, the helical winding will eventually reach the end flange where it meets the barrel at a point 66. At this point, reversal will take plate and a second layer will be built up until the topmost layer reaches end flange 14, at which point another reversal is made to start building up a third layer. Each successive layer becomes slightly wider, for the end flanges of FIG. 1, and the reversal points become further separated as the layers build-up. For example, after seveal layers have built up the widening width of the topmost layer 68 becomes more apparent, as in FIG. 1, and a reversal will take plate at each end of that layer at a top level 70 and a bottom level 72.

According to the present invention, the advance of the strand 14 is measured by a sensor 74 which provides the advance signal on the line 50 to controller 10. This signal is compared, as described above, to the magnitude of the signal on the line 52 from a sensor 76 which may be attached to the drive shaft 46, or which may be a sensor of another type.

An input device 78 provides one or more signals on a line 80 to the controller 10 indicative of the particular spool type selected for winding. This information is stored in the selector device 78 in advance and may include parameters relating to a wide variety of spool types including flat end flanges, tapered end flanges, cylindrica barrels, tapered barrels, or any combination thereof. This prestorage of the various parameters which will be associated with the various types of spools which an operator may wish to wind permits the opator to very quickly enter a code symbol associated with a particulay type of spool to be wound. Signals representative of the parameters for that spool are then automatically loaded into the controller and no further adjustments or other input from the operator is required.

Figure 2:
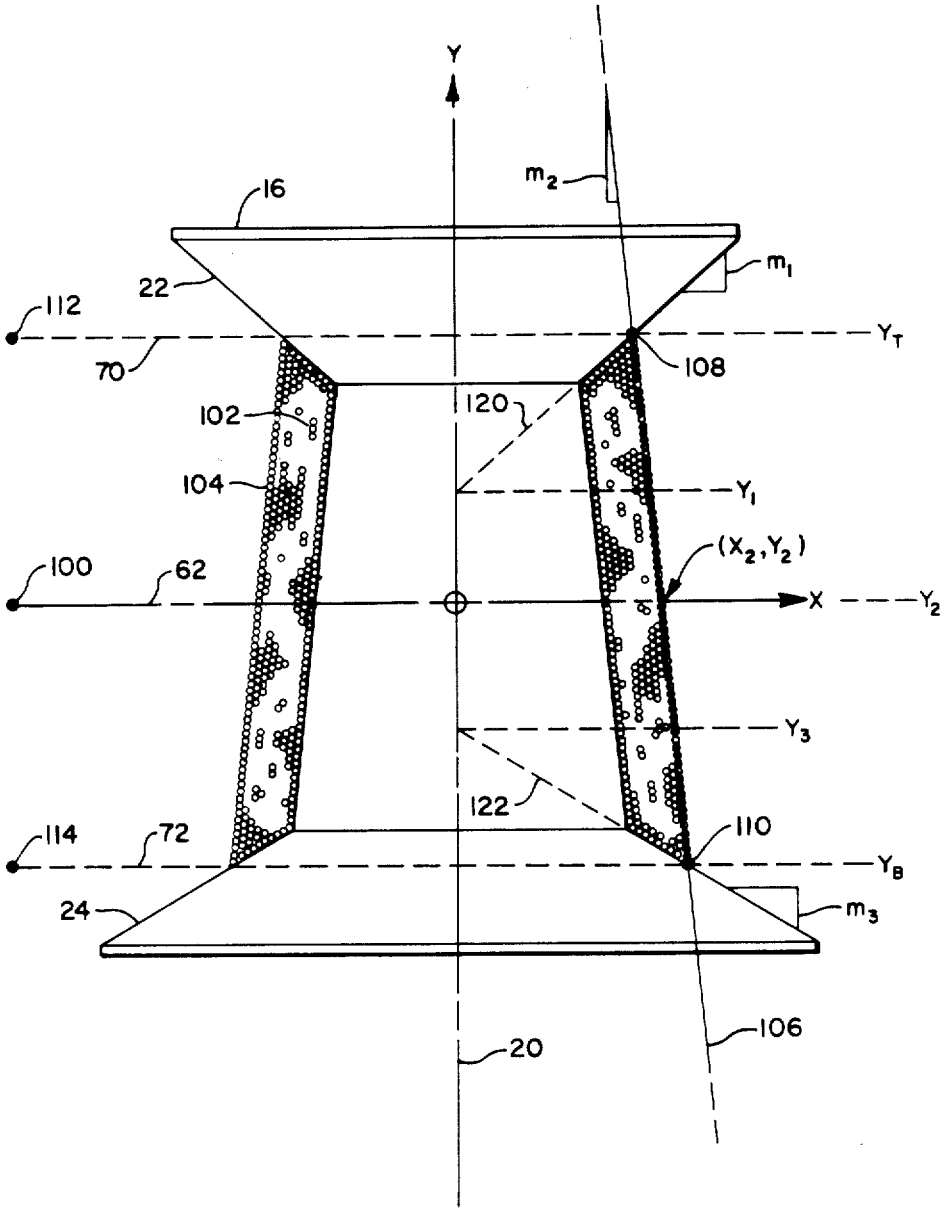
FIG. 2 is an illustration of the principles upon which the present invention is based.

Referring now to FIG. 2, a diagram is presented which illustrates aspects of the principles upon which the present invention is based. There, a spool 16 is shown having a longitudinaly axis of rotation 20 corresponding to the y-axis of a Cartesian coordinate system in which the x-axis is selected, for convenience, to be coincident with the reference line 62 of FIG. 1. Thus, a point 100 on line 62 will be referred to hereinafteras a reference point corresponding to the point at which the home switch is actuated. A build-up of several layers 102 of strand 14 is shown in FIG. 2. The topmost layer presently being wound may be described by a line 106 in the x-y plane of the coordinate system. It is coincident with the topmost layer 104 and has a y-intercept which, though not shown in FIG. 2, will ultimately intersect the y-axis at a point extending beyond the boundaries of the figure. The slope of the line 106 is the same as that of the spool's barrel with respect to the axes of the coordinate system. This information can be preloaded into the spool type selector 78 for loading by an operator into the controller 10.

Line 106 has a pair of intersection points 108, 110 with the end flanges 22, 24, respectively. These points of intersection can be determined by solving, simultantaneously, the equation for line 106 and equations for a pair of lines lying in the surface of the flanges and in the same plane as the x-y plane of the coordinate system. These points of intersection correspond to a pair of reversal points 112, 114 for the traverse mechanism 12.

The mathematical relationships upon which the principles of the invention are based will be described in detail below.

The reversal points 112, 114 may be determined based on several factors, including the period of the spool 16 when the sheave 30 is at a specific height, the period of the wire speed reference wheel or capstan 26, and the present depth dimension of the layers on the spool barrel. When the traverse mechanism reaches and activates the home switch 58, the wire will be winding onto the spool at a known height 62. At this height, the period of the spool is measured by the controller 10 via the signal 52 provided by sensor 76. Also, the controller 10 measures the time for a specific wire length to pass by the capstan 26 via the wire speed signal 50 provided by sensor 74. the controller uses these two time measurements, along with the known spool geometry, to determine the heights 70, 72 at which the present wire surface 104 intersects the top and bottom flange surfaces 22, 24. These are the heights at which the traverse must reverse its direction of travel. The guide sheave continues to travel upward until it reaches top flange intersection height 70. At that point 112, the traverse is sent down to the bottom flange intersection height 72. The traverse is then sent up to the home switch 58 where the process is repeated. The traverse sheave 30 height at any time is kept track of by the controller 10 by means of the sensor 76, the known drive ratio, and the traverse direction.

The basic equation of a line in an x-y coordinate system is:

$$y = mx + b \tag{1}$$

The equation of a top-right flange line 120 in FIG. 2 is:

$$y = m_1x + Y_1 \tag{2}$$

The equation of the bottom-right flange line 122 is:

$$y = m_3x + Y_3 \tag{3}$$

The equation of the wire surface line 106 is:

$$y = m_2x + B_2 \tag{4}$$

where $B_2$ is equal to the y-intercept, not shown, off the top of the page.

The present radius of the spool, including strand, as measured along the x-axis 62 is:

$$R_{SP} = \left[\frac{P_{SP}}{P_{WP}}\right] \cdot R_{WP}, \tag{5}$$

where, $R_{SP}$=radius of the spool, including wire layers, as measured along the x-axis 62 of FIG. 2, $P_{SP}$=period of spool 16, $P_{WP}$=period of wheel 26, and $R_{WP}$=radius of wheel 26.

The radius of the spool at the reference level ($Y_2$) is:

$$R_{SP2} = X_2 = \left[\frac{P_{SP2}}{P_{WP}}\right] \cdot R_{WP}, \tag{6}$$

where, $R_{SP2}$=the radius of the spool at the home switch level, $P_{SP2}$=the period of the spool when wire is winding at the home switch level.

Solving equation (4) for point ($X_2$, $Y_2$):

$$Y_2 = m_2\left[\frac{P_{SP2}}{P_{WP}}\right] R_{WP} + B_2 \tag{7}$$

$$B_2 = Y_2 - m_2R_{WP}\left[\frac{P_{SP2}}{P_{WP}}\right] \tag{8}$$

The equation of the wire surface is then (8)→(4):

$$y = m_2x + Y_2 - m_2R_{WP}\left[\frac{P_{SP2}}{P_{WP}}\right]. \tag{9}$$

The spool radius at the top reversal is at the intersection of equations (9) and (2):

$$m_1X_T + Y_1 = m_2X_T + Y_2 - m_2R_{WP}\left[\frac{P_{SP2}}{P_{WP}}\right] \tag{10}$$

$$X_T(m_1 - m_2) = Y_2 - Y_1 - m_2R_{WP}\left[\frac{P_{SP2}}{P_{WP}}\right]$$

-continued $$X_T = \frac{Y_1 - Y_2}{m_2 - m_1} + \left[ \frac{m_2 R_{WP}}{m_2 - m_1} \cdot \frac{P_{SP2}}{P_{WP}} \right]$$

Substitute (10) into (2) to find the reversal height ($Y_T$)

$$Y_T = m_1 \left[ \frac{Y_1 - Y_2}{m_2 - m_1} + \frac{m_2 R_{WP}}{m_2 - m_1} \cdot \frac{P_{SP2}}{P_{WP}} \right] + Y_1 \quad (11)$$

$$Y_T = \frac{m_1(Y_1 - Y_2)}{m_2 - m_1} + \frac{m_1 m_2 R_{WP} P_{SP2}}{(m_2 - m_1) P_{WP}} + Y_1$$

Similiarly the bottom reversal height ($Y_B$) is $$Y_B = \frac{m_3 (Y_3 - Y_2)}{m_2 - m_3} + \frac{m_3 m_2 R_{WP} P_{SP2}}{(m_2 - m_3) P_{WP}} + Y_3 \quad (12)$$

$P_{SP2}$ and $P_W$ are values measured by the controller. $R_{WP}$ and $Y_2$ are fixed values and are known by the controller. The spool dimensions $Y_1$, $Y_3$, $M_1$, $M_2$ and $M_3$ for all spool types are contained in the memory of the controller. The controller used the spool dimensions in the reversal height calculations for the type of spool that the operator has selected using the spool type selector. Once properly positioned, the home switch need not be adjusted when changing spool types.

Figure 3:
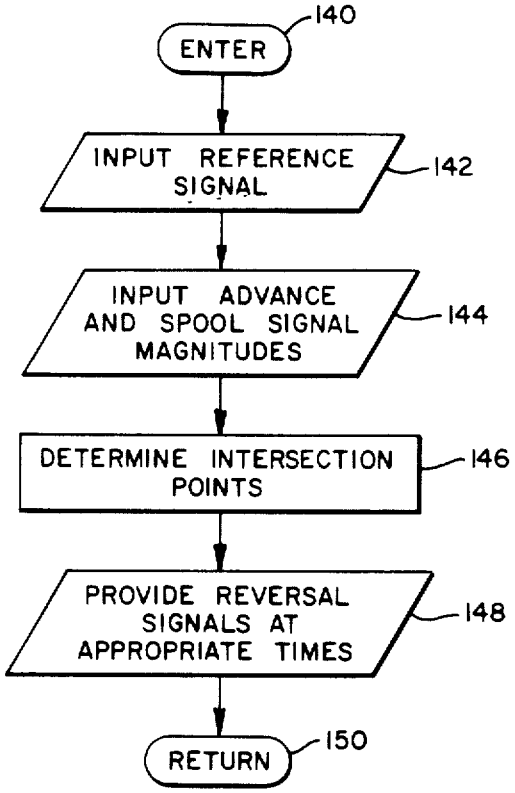
FIG. 3 is a flowchart illustration of logical steps which may be accomplished, according to the present invention, by the signal processor controller of FIG. 4.
Figure 4:
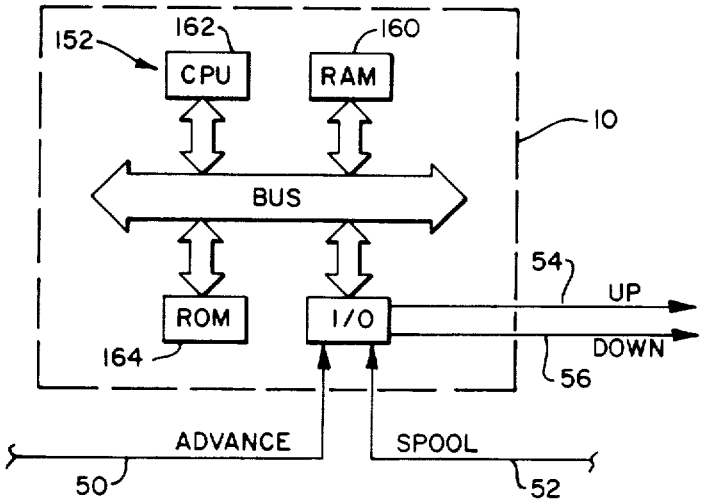
FIG. 4 is an illustration of a signal processor controller, such as the controller illustrated in FIG. 1.

FIG. 3 is an illustration of a series of steps which may be executed by the controller 10 of FIG. 1 as embodied in the signal processor 152 of FIG. 4.

The beginning of the steps, which will be begun each time the home switch 58 is tripped, is indicated in a stop 140. This entering step is followed by a step 142 which indicates the actual physical inputting of the reference signal on the line 64 into the controller 10, After step 142 is executed, the advance signal on the line 50 and the spool signal on the line 52 are both input to the controller and their magnitudes are stored in a RAM unit 160 as illustrated in FIG. 4. A CPU 162 may consult a ROM unit 164 to obtain the necessary steps, in accordance with the mathematical formulas described above, to determine the reversal heights $Y_T$ and $Y_B$ corresponding to the points of intersection 108, 110 of FIG. 2 which in turn correspond to the present depth of the layers of strand 14. After the computation is completed in step 146, a step 148 is next executed in which reversal signals on lines 54, 56 are provided at appropriate times in order to effect the correct reversal of the traverse mechanism 12. A step 150 is next executed in which the signal processor returns to any other programs it may be running or waits until the home switch is again actuaed on the upward movement of the carriage 48.

Figure 5:
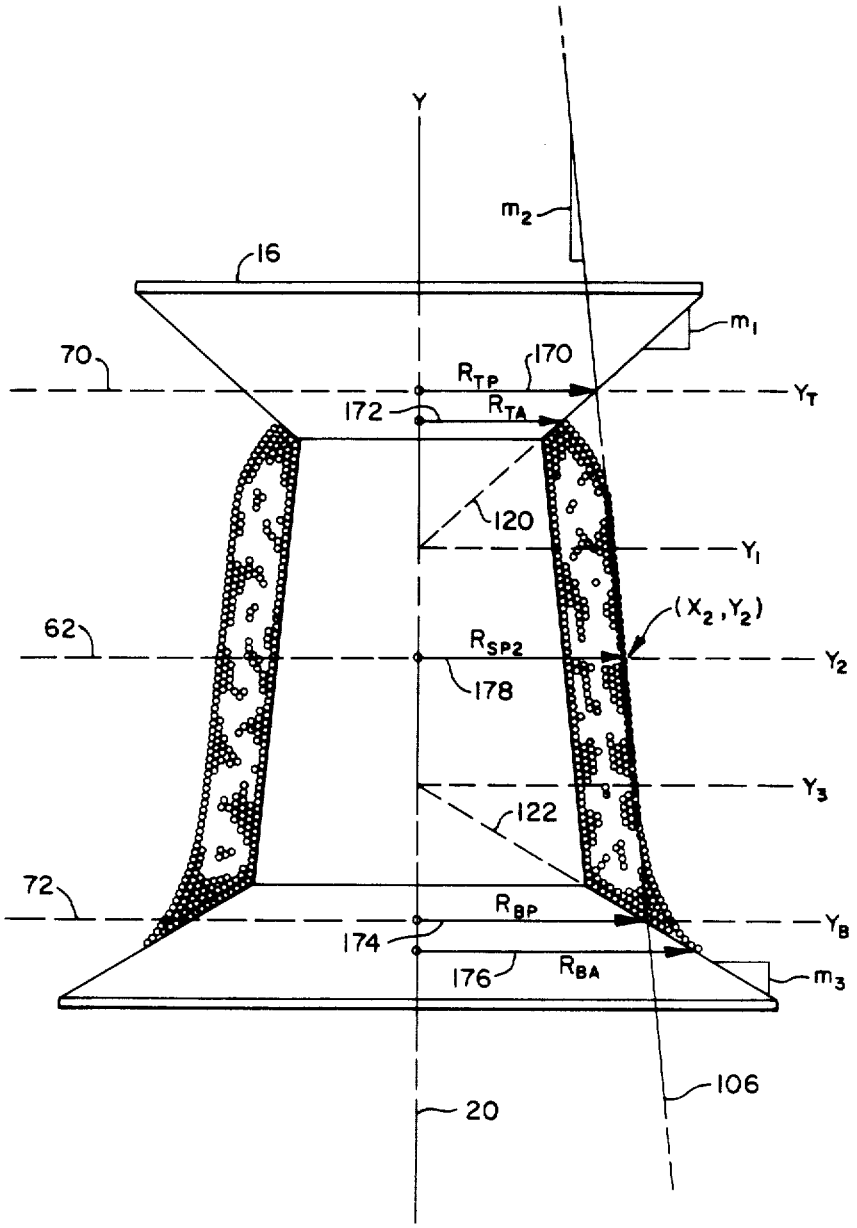
FIG. 5 is an illustration of the principles upon which the fill correction aspect of the present invention is based.

Referring now to FIG. 5, a diagram is presented which illustrates principles upon which the second aspect of the present invention is based. There, the spool 16 is shown having the same longitudinal axis of rotation 20 corresponding to the y-axis of the Cartesian coordinate system shown in FIG. 2 in which the x-axis is selected, for convenience, to be coincident with the reference lie 62 of FIG. 1. This also corresponds to the level designated as $Y_2$. The point 100 on line 62 of FIG. 1 still pertains, but is omitted from FIG. 5 for the sake of simplicity. A build-up of several layers of strand is also shown in FIG. 5, similar to that shown in FIG. 2, except that the fill has not gone as smoothly as in FIG. 2. In other words, improper fill has taken place leaving a "valley" at the top end of the spool as indicated by the difference between the proper radius ($R_{TP}$) 170 and the actual radius ($R_{TA}$) 172 of the spool wire surface at the top flange, and leaving an excess of fill at the bottom end as indicated by the difference between the proper radius ($R_{BP}$) 174 and the actual radius ($R_{BA}$) 176 at the bottom flange. This is due to incorrct reversal points which may be caused by any number of factors including differences between individual spools within a spool type caused, for example, by manufacturing tolerances.

The improper fill is corrected for by adjusting the $Y_1$ and $Y_3$ values used to calculate the reversal heights. If a surplus of wire in excess of a predetermined amount is detected at the top flange, $Y_1$ is decreased by an incremental amount (delta) within the controller. Conversely, if a substantial void of wire is detected, $Y_1$ is increased incrementally. If a substantial surplus of wire is detected at the bottom flange, $Y_3$ is increased. And, if a substantial void is detected at the bottom flange, $Y_3$ is decreased. Again, this is accomplished incrementally, so that several passes may be required to correct a large error.

The fill of the spool is determined at the point at which the traverse reversed by comparing the speed of the spool to the speed of the wire. The radius of the wire surface at the point the wire is winding onto the spool is equal to the rotary speed of the wire speed reference wheel 26 divided by the rotary speed of the spool multiplied by the radius of the wire speed reference wheel. the spool radii at the reversal points are compared to the proper spool radii which are determined based on the geometry of the spool and the current wire surface radius at a reference point away from the flanges. The spool radius at the selected reference point ($R_{SP2}$) 178 is equal to the wire speed reference wheel radius ($R_W$) times the ratio of the reference wheel speed ($W_\omega$) and the spool speed while the wire is winding at the reference point ($W_{\omega Z}$). The geometry of the spool, as before, consists of a combination of flat or tapered flanges and a cylindrical or tapered barrel.

Derivation of equations for the proper fill radii at the top and bottm is as follows:

The basic equation of a line in an x-y coordinate system is, as in equation (1):

$$y = mx + b. \quad (13)$$

The equation of the top right flange line 120 is FIG. 5 is:

$$y = m_1 x + Y_1. \quad (14)$$

The equation of the bottom right flange line 122 is:

$$y = m_3 x + Y_3. \quad (15)$$

The equation of the wire surface line 106 is:

$$y = m_2 x + B_2, \quad (16)$$

where $B_2$ is equal to the y-intercept, not shown, off the top of the page.

Solving equation (4) for point ($X_2$, $Y_2$):

$$Y_2 = m_2 X_2 + B_2$$

$$B_2 = Y_2 - m_2 X_2 \quad (17)$$

The equation of the wire surface line is then (17)→(16):

$$y = m_2x + Y_1 - m_2X_2 \quad (18)$$

The proper spool radius at the top ($R_{TP}$) is equal to the x value, where the top flange surface line 120, as defined by equation (14), intersects the wire fsurface line 106, as defined by equation (18). Solving for $X_T$, we obtain:

$$m_2X_T + Y_2 - m_2X_2 = m_1X_T + Y_1 \quad (19)$$

$$m_2X_T - m_1X_T = Y_1 + m_2X_2 - Y_2$$

$$X_T = \frac{Y_1 - Y_2 + m_2X_2}{m_2 - m_1}$$

Since $R_{TP} = X_T$ and $R_{SP2} = X_2$, the proper spool radius at the top is:

$$R_{TP} = \frac{Y_1 - Y_2 + m_2R_{SP2}}{m_2 - m_1} \quad (20)$$

The present radius of the spool, including strand, as measured in the direction of the x-axis 62 is:

$$R_{SP} = \left[\frac{\omega_W}{\omega_{SP}}\right] R_W \quad (21)$$

The radius of the spool at the reference level ($Y_2$) is then:

$$R_{SP2} = \left[\frac{\omega_{WZ}}{\omega_{SP2}}\right] R_W \quad (22)$$

Combining equations (20) and (22);

$$R_{TP} = \frac{Y_1 - Y_2}{m_2 - m_1} + \left[\frac{m_2R_W}{m_2 - m_1}\right] \frac{\omega_{WZ}}{\omega_{SP2}} \quad (23)$$

Likewise the proper spool radius at the bottom is:

$$R_{BP} = \frac{Y_3 - Y_2}{m_2 - m_3} + \left[\frac{m_2R_W}{m_2 - m_3}\right] \frac{\omega_{WZ}}{\omega_{SP2}} \quad (24)$$

The proper spool radii must be compared to the actual spool radii. The actual spool radii are:

$$R_{TA} = \left[\frac{\omega_{WT}}{\omega_{SPT}}\right] RW, \text{ and}$$

$$R_{BA} = \left[\frac{\omega_{WS}}{\omega_{SPB}}\right] RW$$

where, $R_{BA}$ = Actual radius of spool wire surface at the bottom flange, $R_{BP}$ = Proper radius of spool wire surface at the bottom flange, $R_{SPL}$ = Radius of spool wire surface at reference ($X_2$, $Y_2$), $R_{TA}$ = Actual radius of spool wire surface at the bottom flange, $R_{TP}$ = Proper radius of spool wire surface at the top flange, $R_W$ = Radius of the wire speed reference wheel, $\omega_{SP}$ = Rotary speed (angular velocity) of the spool.

$\omega_{SP2}$ = Rotary speed (angular velocity) of the spool when the wire is winding at reference point ($X_2$, $Y_2$), p0 $\omega_{SPT}$ = Rotary speed (angular velocity) of the spool when the traverse is at the top of its travel, $\omega_W$ = Rotary speed of the wire speed reference wheel, $\omega_{W2}$ = Rotary speed (angular velocity) of the wheel when the wire is winding at point ($X_2$, $Y_2$), $\omega_{WB}$ = Rotary speed (angular velocity) of the wheel when the traverse is at the bottom of its travel, $\omega_{WT}$ = Rotary speed (angular velocity) of the wheel when the traverse is at the top of its travel.

Figure 6:
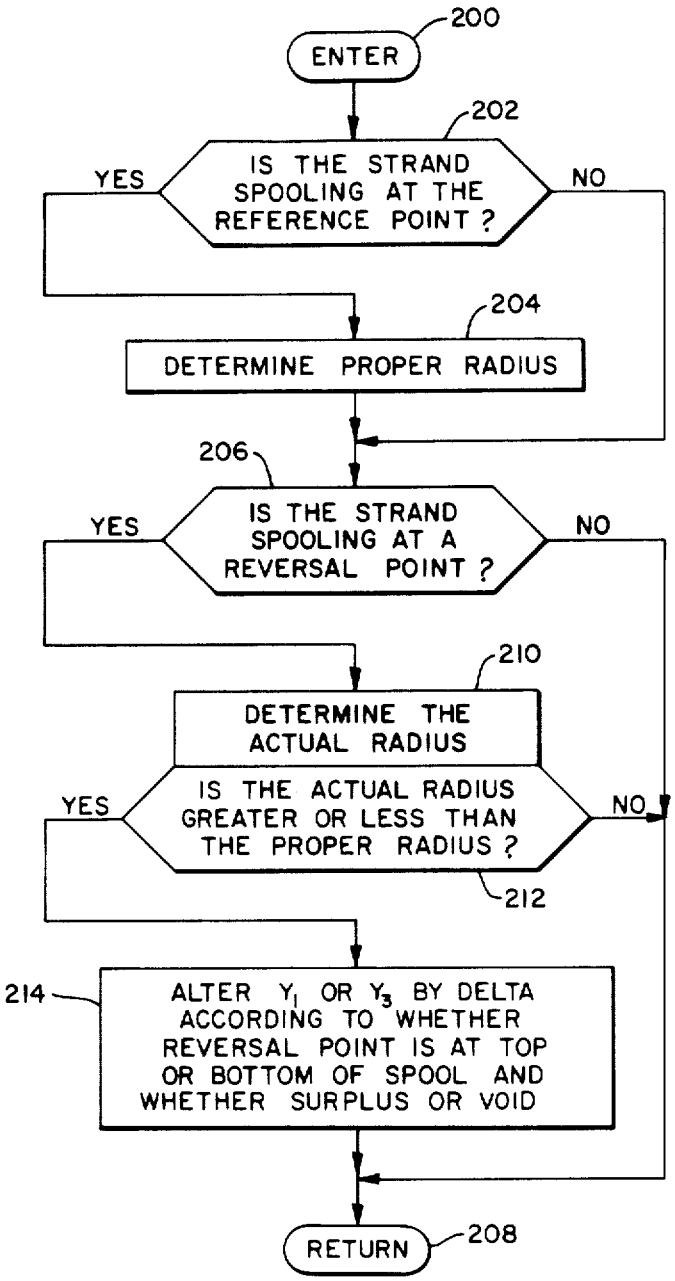
FIG. 6 is a flowchart illustration of logical steps which may be accomplished, according to the fill correction aspect of the present invention, by the signal processor controllre of FIG. 4.

Referring now to FIG. 6, a flowchart is there illustrated of the logical steps which would be carried out by, for example, the signal processor 10 of FIG. 4 in checking for and making corrections for reversal points due to improper fill.

After entering at a stop 200, a decision step 202 is next xecuted in which a determination is made as to whether or not the strand is spooling at the selected reference point. If so, a step 204 is next executed in which a determination is made as to the proper radius. This is determined based on the geometry of the spool and the current wire surface radius at the reference point which is selected to be not near the flanges. The spool radius at the reference point is equal to the wire speed wheel radius times the ratio of the reference wheel spee and the spool speed while the wire is winding at the reference point. The geometry of the spool, of course, consists of any combination of flat or tapered flanges and cylindrical or tapered barrel as described above in connection with the first aspect of the present invention.

If a negative determination is made in step 202 or, after executing step 204, a decision step 206 is next executed in which a determination is made as to whether or not the strand is spooling at a reversal point. If not, a return is made via a step 208. If so, a determination is made in a step 210 as to the actual radius of the strand built up on the spool at the reversal point. This is equal to the rotary speed of the wire speed reference wheel divided by the rotary speed of the spool multiplied by the radius of the reference wheel. A step 212 is next executed in which the actual radius of step 210 is compared to the proper radius of step 204 in order to determine whether a discrepancy greater than a predetermined amount exists or not. If not, a return is made via step 208. If so, the value of either $Y_1$ or $Y_3$ must be altered by some selected delta amount as shown in a step 214. If a surplus of wire in excess of the predetermined amount is detected at the top flange, $Y_1$ is decreased by the delta amount. Conversely, if a substantial void of wire is detected, $Y_1$ is increased by the delta amount. If a substantial surplus of wire is detected at the bottom flange, $Y_3$ is increased by the delta amount. And, if a substantial void is detected at the bottom flange, $Y_3$ is decreased by the delta amount. $Y_1$ and $Y_3$ are selected for alteration because they play an important role in the calculation of the reversal points, as described hereinbefore in connection with equations (1)–(12). After altering $Y_1$ or $Y_3$, a return is made in the step 208.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

I claim:

1. A method for correcting a reversal point signal for a traverse mechanism for guiding a strand from a rotating reference wheel back and forth between reveral points in end flange surfaces of a rotating spool to form a helical winding in successive layers onto a barrel of the spool, comprising the steps of:

sensing the angular velocity of the reference wheel and providing a reference wheel signal having a magnitude indicative thereof;

sensing the angular velocity of the spool and providing a spool signal indicative thereof;

providing a wheel radius signal having a magnitude indicative of the radius of the reference wheel;

determining the actual radius from the spool's rotation axis of the topmost layer on the barrel at a selected reference point between the spool's flanges by dividing the magnitude of said reference wheel signal by the magnitude of said spool signal to obtain a first ratio signal and multiplying the magnitude of said first ratio signal by said wheel radius signal and providing an actual topmost layer radius signal;

determining proper topmost layer radius from the spool's rotation axis at a rversal point by determining the point of intersection of a line parallel to the spool barrel and lying in the actual topmost layer, as indicated by the magnitude of said actual topmost layer radius signal, and a fixed line lying in the flange surface corresponding to said reversal point and provindg a proper topmost layer radius signal having a magnitude indicative of said proper topmost layer radius;

determining the actual reversal point topmost layer radius at said reversal point by dividing the magnitude of said reference wheel signal by the magnitude of said spool signal to obtain a second ratio signal and multiplying the magnitude of said second ratio signal by the magnitude of said wheel radius signal to obtain an actual reversal point topmost layer radius signal; and comparing the magnitude of said proper topmost layer radius signal to the magnitude of said actual reversal point topmost layer radius signal and altering the reversal point signal by a selected incremental amount in the presence of a difference in magnitudes.

2. Apparatus, for correcting a reversal point signal for a traverse mechanism for guiding a strand from a rotating reference wheel back and forth between reversal ponts in end flange surfaces of a rotating spool to form a helical winding in successive layers onto a barrel of the spool, comprising:

means responsive to the angular velocity of the reference wheel for providing a reference wheel signal having a magnitude indicative of the angular velocity of the reference wheel;

means responsive to the angular velocity of the spool for providing a spool signal indicative of the angular velocity of the spool;

means for providing a wheel radius signal having a magnitude indicative of the radius of the reference wheel; and signal processing means, responsive to said wheel radius signal, said reference wheel signal and said spool signal for determing the actual radius from the spool's rotation axis of the topmost layer on the barrel at a selected reference point between the spool's flanges by dividing the magnitude of said reference wheel signal at said reference point by the magnitude of said spool signal at said reference point to obtain a first ratio signal and multiplying the magnitude of said first ratio signal by said wheel radius signal to obtain an actual topmost layer radius signal at said reference point, said signal processing means determining proper topmost layer radius from the spool's rotation axis at a reversal point by determining the point of intersection of a line parallel to the spool barrel and lying in the actual topmost layer at said reference point, as indicated by the magnitude of said actual topmost layer radius signal, and a fixed line lying in the flange surface at said reversal point and providing a proper topmost layer radius signal having a magnitude indicative of said proper topmost layer radius, said signal processing means determining the actual reversal point topmost layer radius at said reversal point by dividing the magnitude of said reference wheel signal by the magnitude of said spool signal to obtain a second ratio signal and multiplying the magnitude of said second ratio signal by the magnitude of said wheel radius signal to obtain an actual reversal point topmost layer radius signal, said signal processing means comparing the magnitude of said proper topmost layer radius signal to the magnitude of said actual reversal point topmost layer radius signal and altering the reversal point signal by a selected incremental amount in the presence of a difference in magnitudes.

* * * * *

UNITED STATES PATENT AND TRADEMARK OFFICE

CERTIFICATE OF CORRECTION

PATENT NO. : 4,725,010

DATED : February 16, 1988

INVENTOR(S) : David J. Lothamer

It is certified that error appears in the above-identified patent and that said Letters Patent is hereby corrected as shown below:

| | |
|---|---|
| Column 13, line 7. | Cancel "reveral" and substitute -- reversal -- |
| Column 13, line 28. | Cancel "rversal" and substitute -- reversal -- |
| Column 13, line 34. | Cancel "provindg" and substitute -- providing -- |
| Column 14, line 17. | Cancel "determing" and substitute -- determining -- |

Signed and Sealed this

Fifth Day of July, 1988

*Attest:*

*Attesting Officer*

DONALD J. QUIGG

*Commissioner of Patents and Trademarks*